US009364084B2

(12) United States Patent
Rege

(10) Patent No.: US 9,364,084 B2
(45) Date of Patent: Jun. 14, 2016

(54) TWO-TIERED BOOT TRAY WITH UMBRELLA DRIP TRAY STAND

(71) Applicant: Vishal Durgadutt Rege, New Delhi (IN)

(72) Inventor: Vishal Durgadutt Rege, New Delhi (IN)

( * ) Notice: Subject to any disclaimer, the term of this patent is extended or adjusted under 35 U.S.C. 154(b) by 0 days.

(21) Appl. No.: 14/731,028

(22) Filed: Jun. 4, 2015

(65) Prior Publication Data

US 2015/0351534 A1 Dec. 10, 2015

Related U.S. Application Data

(60) Provisional application No. 62/007,604, filed on Jun. 4, 2014.

(51) Int. Cl.

| | |
|---|---|
| ***A47L 23/20*** | (2006.01) |
| ***A47B 61/04*** | (2006.01) |
| ***A47G 25/12*** | (2006.01) |
| *A47B 87/02* | (2006.01) |

(52) U.S. Cl.

CPC ..... *A47B 61/04* (2013.01); *A47G 25/12* (2013.01); *A47B 87/0223* (2013.01); *A47L 23/20* (2013.01); *Y10T 29/49828* (2015.01)

(58) Field of Classification Search

CPC ..... A47B 61/04; A47B 87/0207; A47B 87/0215; A47B 87/0223; A47B 87/0246; A47B 87/0253; A47B 87/0261; A47B 2087/023; A47B 2087/0238; A47G 25/12; A47L 23/20; A47L 23/205; A47L 23/22; Y10T 29/49828

USPC ..... 211/36, 37, 41.1, 41.3, 60.1, 62, 70.2, 211/70.5, 70.6, 70.8

See application file for complete search history.

(56) References Cited

U.S. PATENT DOCUMENTS

| | | | | |
|---|---|---|---|---|
| 322,987 A | | 7/1885 | Smith | |
| 328,487 A | * | 10/1885 | Hendryx | A47G 25/12 211/62 |
| 508,602 A | * | 11/1893 | Danner | A47G 25/12 211/62 |
| 710,790 A | * | 10/1902 | Magerhans | A47G 25/12 211/200 |
| 716,596 A | * | 12/1902 | Taussig | A47F 3/004 211/62 |
| 720,452 A | * | 2/1903 | Manoha | A47F 3/004 211/62 |

(Continued)

FOREIGN PATENT DOCUMENTS

| | | | | |
|---|---|---|---|---|
| EP | 0101647 A2 | * | 2/1984 | A47B 87/0223 |

OTHER PUBLICATIONS

LeeValley and Veritas. (Dec. 9, 2011). Two-Tier Boot Tray. Retrieved on Feb. 23, 2016 via the Wayback Machine at <https://web.archive.org/web/20111209113012/http://www.leevalley.com/us/garden/page.aspx?p=62086&cat=2,51676&ap=1>.*

*Primary Examiner* — Joshua Rodden

(74) *Attorney, Agent, or Firm* — Brian S. Steinberger; Law Offices of Brian S. Steinberger P.A.

(57) ABSTRACT

Stands, devices, systems and methods for supporting umbrellas in vertical orientations and different levels with raised ridges and sidewalls for allowing outdoor footwear to dry. The stands can include two tier levels, each with raised sidewalls and posts for allowing a top tier to be supported over a bottom tier. The tiers can have parallel raised ridges for allowing drying and airflow under wet outer footwear placed on each tier. Male members and female sockets on the trays can be attached to hollow posts in order to attach the trays to one another. At least one opening in the top tier can allow for a wet umbrella to be stored. The trays can prevent water, rain, melted snow, dirt and mud from getting on the floor while holding the umbrellas and outer footwear in an organized manner.

10 Claims, 9 Drawing Sheets

(56) References Cited

U.S. PATENT DOCUMENTS

| | | | | | |
|---|---|---|---|---|---|
| 1,095,814 | A * | 5/1914 | Champion | A47G 25/12 | 211/195 |
| 1,661,098 | A | 2/1928 | Side | | |
| D80,453 | S | 2/1930 | Pierl | | |
| 3,170,415 | A * | 2/1965 | Svilokos | A47B 61/04 | 108/27 |
| 4,595,107 | A | 6/1986 | Welsch | | |
| 4,635,563 | A * | 1/1987 | Hand | A47B 96/024 | 108/107 |
| 4,843,975 | A * | 7/1989 | Welsch | A47B 96/021 | 108/192 |
| 4,940,150 | A * | 7/1990 | Spengler | A47B 87/0223 | 211/133.1 |
| 4,949,648 | A | 8/1990 | Miller | | |
| D354,382 | S | 1/1995 | Mogensen | | |
| 5,722,544 | A * | 3/1998 | Williams | A47B 87/0246 | 108/107 |
| 5,833,250 | A * | 11/1998 | Schier | B62B 1/22 | 280/47.19 |
| D429,071 | S * | 8/2000 | Hurt | D3/315 | |
| D553,688 | S | 10/2007 | Bonaventura | | |
| D555,871 | S | 11/2007 | Pong | | |
| 7,367,136 | B1 | 5/2008 | D'Antonio | | |
| D577,172 | S | 9/2008 | Coderre | | |
| D657,588 | S | 4/2012 | Snider | | |
| D721,904 | S | 2/2015 | Tsai | | |
| 2003/0085188 | A1 | 5/2003 | Klein | | |
| 2003/0178383 | A1 * | 9/2003 | Craft | A47B 81/00 | 211/85.7 |
| 2004/0118796 | A1 * | 6/2004 | Chen | A47B 81/00 | 211/70.6 |
| 2004/0188367 | A1 * | 9/2004 | Pleiman | B25H 3/04 | 211/70.6 |
| 2005/0205499 | A1 * | 9/2005 | Botner | A47B 43/00 | 211/34 |
| 2008/0073300 | A1 * | 3/2008 | Abraitis | A47B 61/04 | 211/36 |

* cited by examiner

TWO-TIERED BOOT TRAY WITH UMBRELLA DRIP TRAY STAND

CROSS REFERENCE TO RELATED APPLICATIONS

This application claims the benefit of priority to U.S. Provisional Application Ser. No. 62/007,604 filed Jun. 4, 2014, the entire disclosure of which is incorporated by reference in its' entirety.

FIELD OF INVENTION

This invention relates to umbrellas stands and footwear drying racks, and in particular to stands, devices, systems and methods for supporting umbrellas in vertical orientations, and different levels with raised ridges and sidewalls for allowing outdoor footwear to dry and preventing water and dirt from reaching the floor.

BACKGROUND AND PRIOR ART

It is common for many individuals to leave wet and dirty outer footwear, such as shoes, boots, galoshes, and the like, as well wet umbrellas near the entryway of a house. However, wet and dirty shoes and wet umbrellas create a mess on the floor, which can cause damage to the floor, such as wood floors. Additionally, others can walk through the dirty floor spots and wet floors, and track the dirt and wetness throughout the house. In addition, wet floors can be a hazard to others needing to walk throughout the space.

Over the years some devices have been proposed to help organize shoes and umbrellas separately. However, these devices are often bulky and are not versatile. Thus, there is a need in the prior art for a device that organizes shoes and umbrellas while reducing the clutter and mess of wet umbrellas and wet and dirty outdoor footwear.

Some devices known in the art that claim umbrella and footwear stands. For example, U.S. Pat. No. 1,661,098 to Side, shows a large article rack having a closed box appearance for holding footwear such as boots upside down, and larger box section for holding umbrella that would be impractical based on both size and undesirable appearance factors to be used.

U.S. Design Pat. No. D80,453 to Pieri shows a stand, which resembles a towel rack with parallel rods over narrow depth shelves were shoes must be supported sideways, In addition to being impractical and unsightly, any water or dirt to drop from the footwear supports rods easily falls onto the hat and shoe on the shelves underneath. Additionally, the shelves would not stop puddling water from running over the shelf sides.

U.S. Pat. No. 7,367,136 to D'Antonio shows an umbrella holder with electrical blower on a floor mat for footwear. This device requires installation next to a wall plug that may not be practical in the entryway of many homes, unless an extension cord is provided. Additionally, placing electrical power next to wet umbrellas is a potential hazard.

These prior art devices, however, fail to provide a two-tiered shoe rack with a plurality of apertures for holding umbrellas therein.

Thus, the need exists for solutions to the above problems with the prior art.

SUMMARY OF THE INVENTION

A primary objective of the present invention is to provide stands, devices, systems and methods for a multipurpose two tier outer footwear tray with umbrella drip holder.

A secondary objective of the present invention is to provide an easy to assemble and disassemble stand, device, system and method for supporting umbrellas in vertical orientations and different levels with raised ridges and sidewalls for allowing outdoor footwear to dry.

A third objective of the present invention is to provide a multipurpose stand for outer footwear, such as boots, and shoes and umbrellas, which prevents formation of puddles and dirt droppings on an adjacent floor surface.

A multipurpose stand for storing and allowing wet outer footwear and umbrellas to dry, can include a bottom elongated tray with a solid surface, a top tray having a first end with at least one opening through the top tray, and a plurality of posts for supporting the top tray above the bottom tray, wherein the top tray and the bottom tray are adaptable for holding wet outer footwear thereon, and the at least one opening adaptable for a wet umbrella to be supported in a substantially vertical orientation.

The top tray and the bottom tray can each have a rectangular configuration. At least one of the top tray and the bottom tray can include raised outer perimeter side walls for preventing water and dirt from wet outer footwear from overflowing the trays.

At least one of the top tray and the bottom tray can include parallel raised ridges to aid in drying and air circulation underneath wet outer footwear.

The stand can include a plurality of posts, that can be hollow. The upper tray and/or the bottom tray can include sockets or protruding male members, where ends of the posts can mateably attach by male members being frictionally attached to female members.

The at least one opening through the top tray can include a plurality of openings parallel to one of the raised outer perimeter side walls for allowing plural umbrellas to be vertically stored and allowed to dry.

The stand can work with just a bottom tray having a rectangular configuration, with raised sidewalls, and a plurality of parallel raised ridges to aid in drying and air circulation underneath wet outer footwear.

A method of assembling a multipurpose stand for wet outer footwear and umbrellas, can include the steps of providing a bottom tray with raised sidewalls, a plurality of raised ridges, and sockets or male members, providing a top tray with raised side walls, a plurality of raised ridges and male members or sockets, providing a plurality of hollow posts, each having top ends and bottom ends, that mateably attach to sockets or male members.

The method can further include the step of providing at least one opening in the top tray adaptable for a wet umbrella to be supported in a substantially vertical orientation.

Further objects and advantages of this invention will be apparent from the following detailed description of the presently preferred embodiments which are illustrated schematically in the accompanying drawings.

DESCRIPTION OF THE PREFERRED EMBODIMENTS

Figure 1:
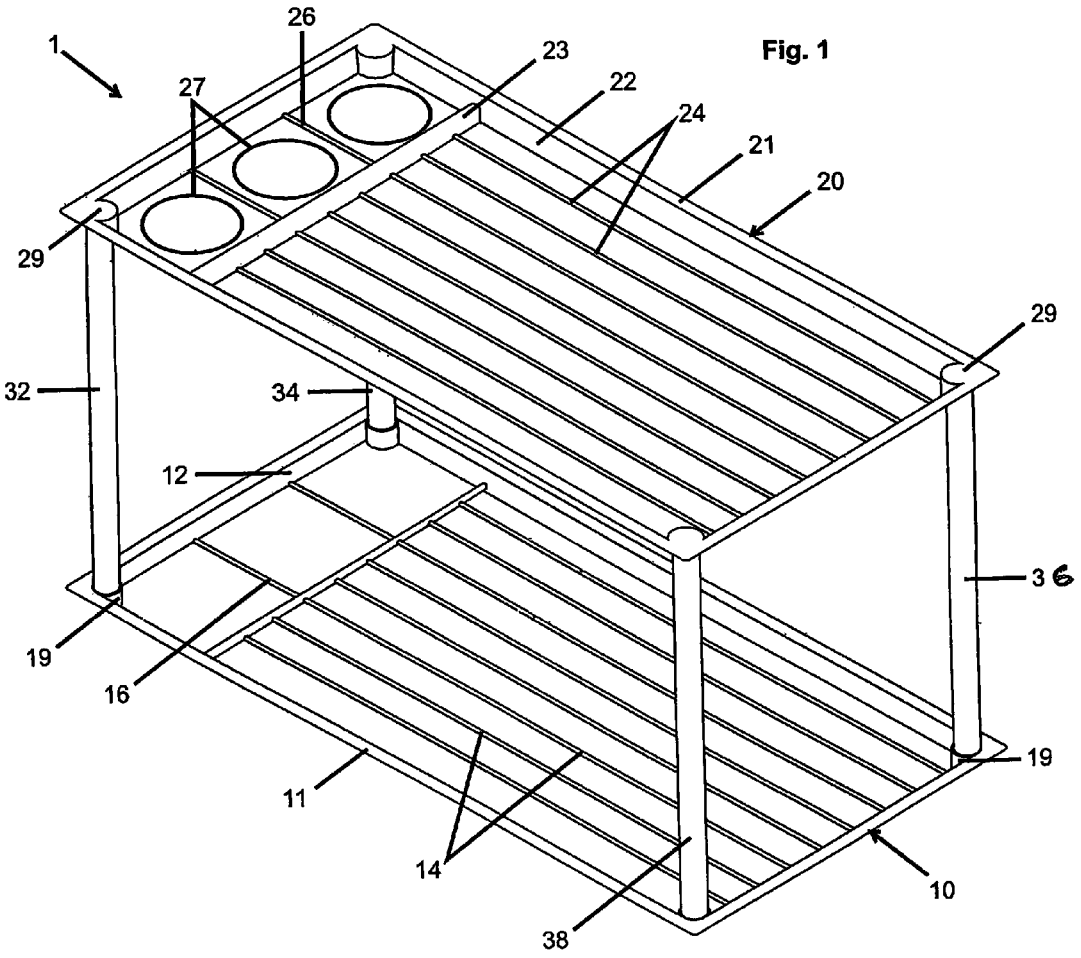
FIG. 1 is an upper front right perspective view of the two tiered boot trays with umbrella drip tray stand.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention.

It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components will now be described.

1 multipurpose two tiered stand for umbrellas and outdoor footwear
10 bottom tray
11 bottom rim
12 raised outer perimeter sidewalls
14 parallel raised ridges
16 raised box outlines under circular openings for umbrella
19 upwardly protruding sockets on corners of bottom tray
20 top tray
21 top rim
22 raised outer perimeter sidewalls
23 raised sidewall next to umbrella section
24 parallel raised ridges
26 raised box outlines
27 circular openings (round apertures) for umbrellas
29 downwardly protruding male stem members underneath top tray
32 first pipe leg(post)
34 second pipe leg(post)
36 third pipe leg(post)
38 fourth pipe leg(post)

Figure 2:
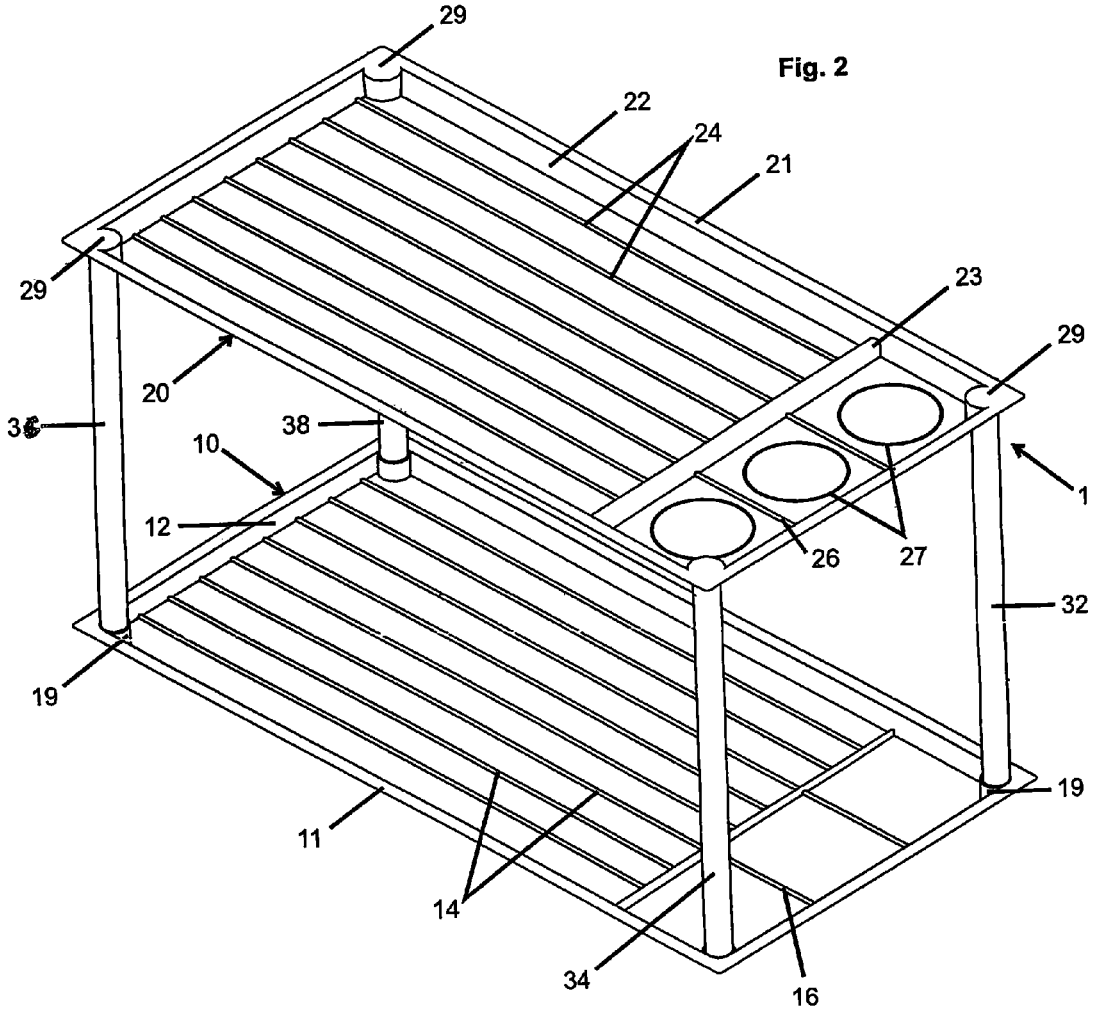
FIG. 2 is an upper front left perspective view of the stand of FIG. 1.
Figure 3:
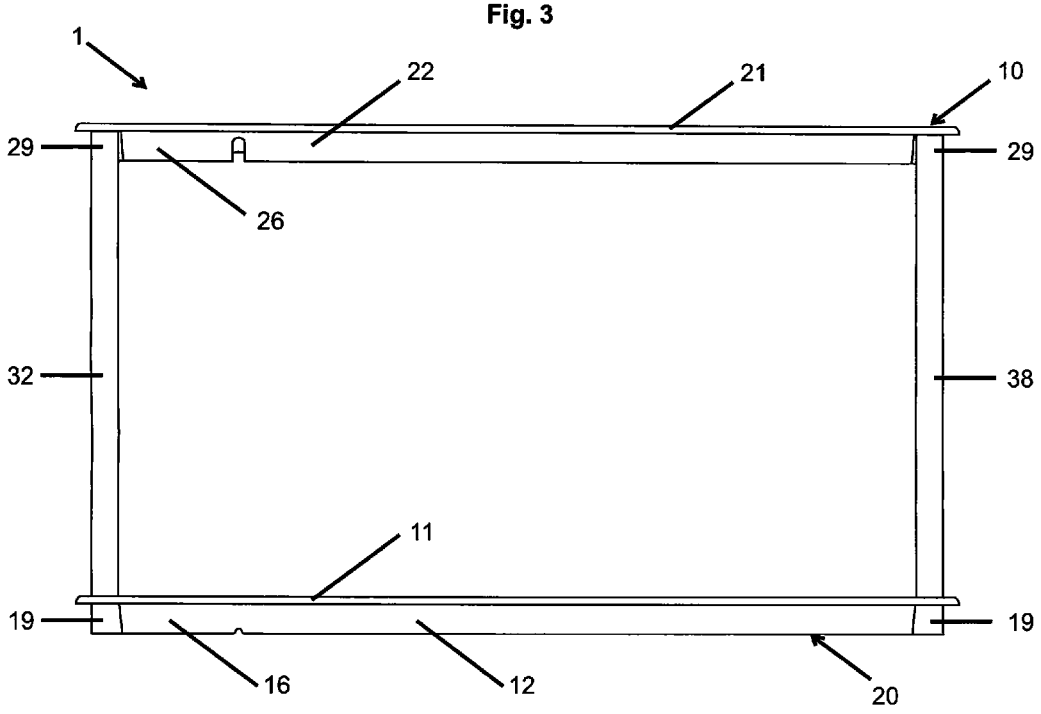
FIG. 3 is a front view of the stand of FIG. 1.
Figure 4:
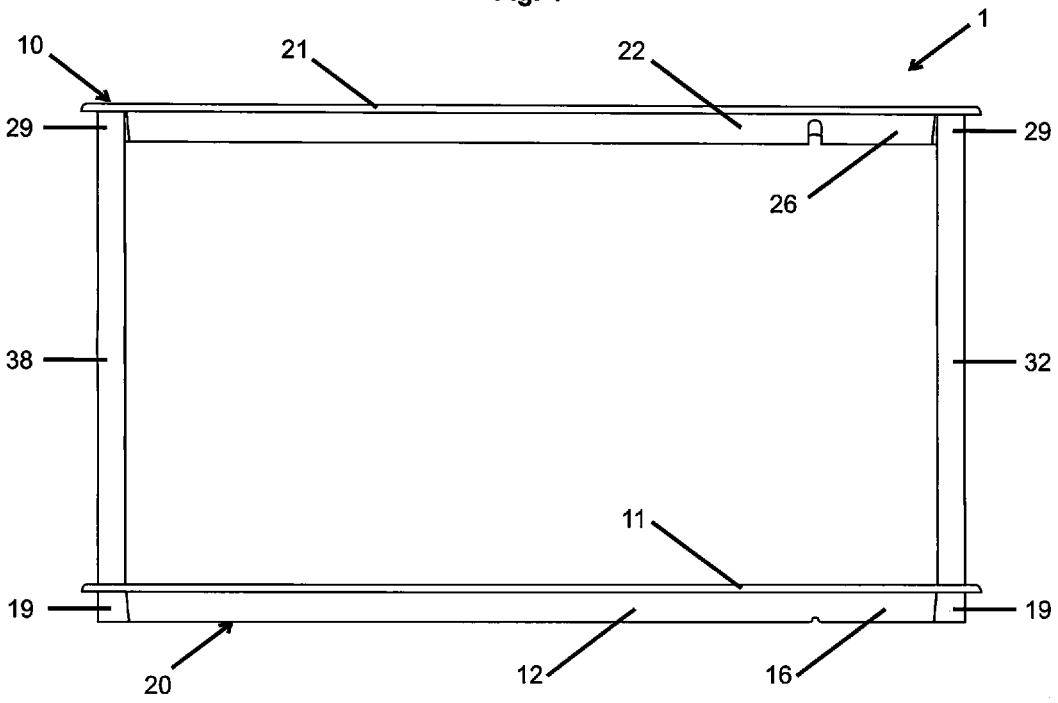
FIG. 4 is a rear view of the stand of FIG. 1.
Figure 5:
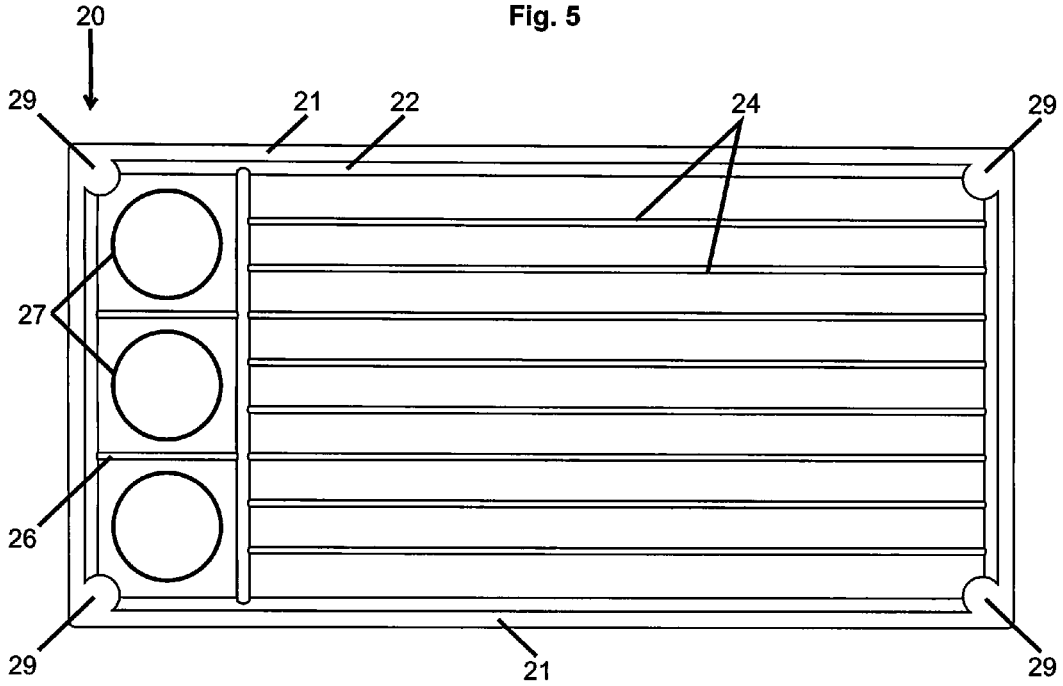
FIG. 5 is a top view of the stand of FIG. 1.
Figure 6:
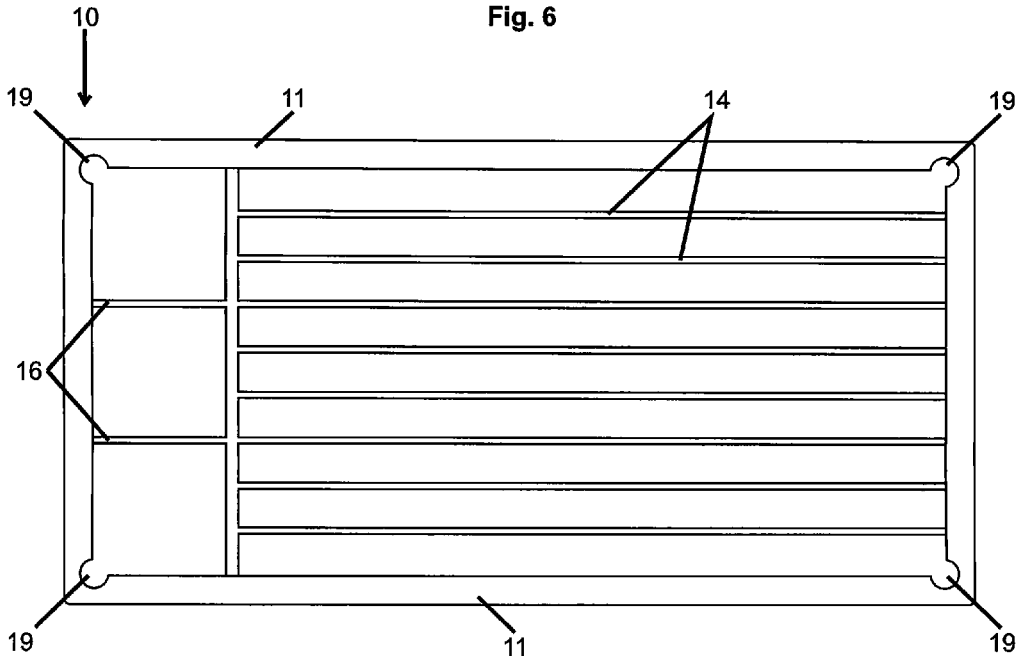
FIG. 6 is a bottom view of the stand of FIG. 1.
Figure 7:
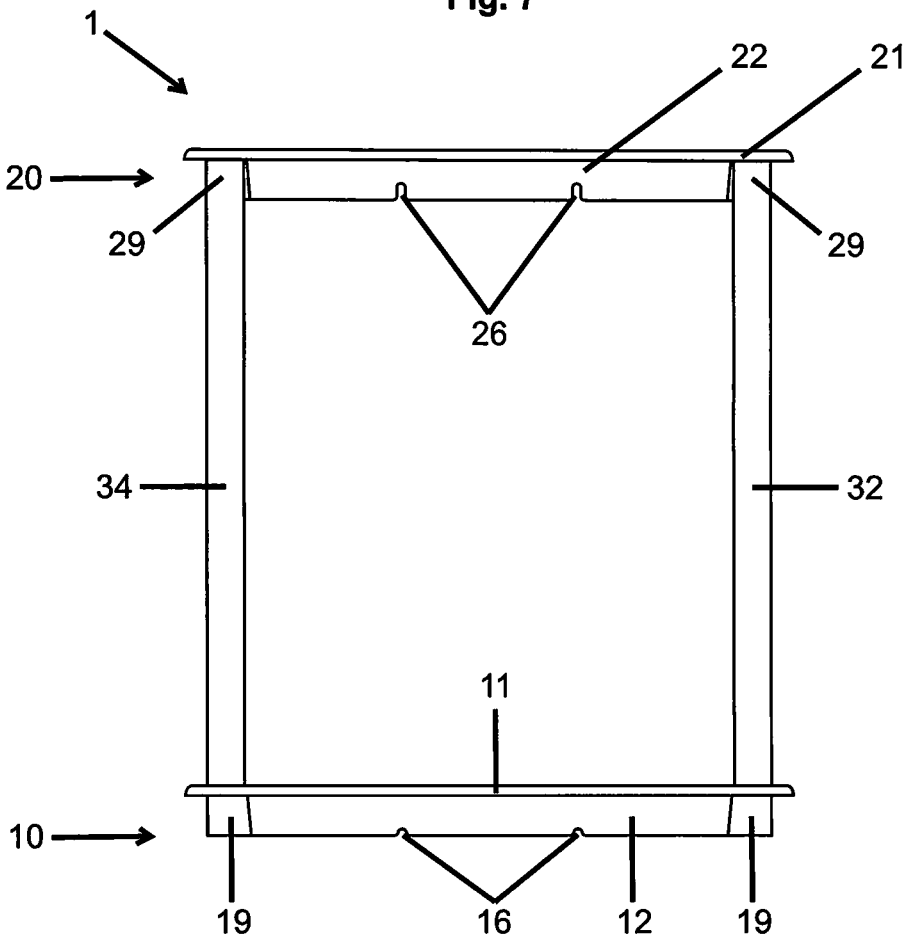
FIG. 7 is a left side view of the stand of FIG. 1.
Figure 8:
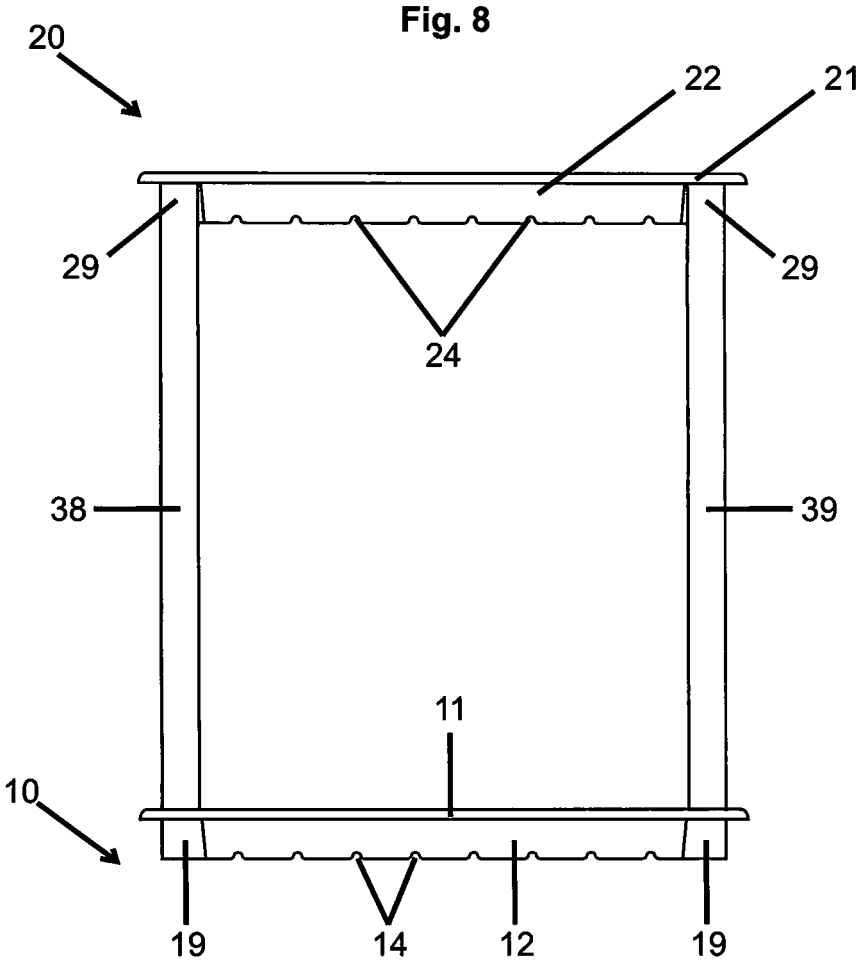
FIG. 8 is a right side view of the stand of FIG. 1.
Figure 9:
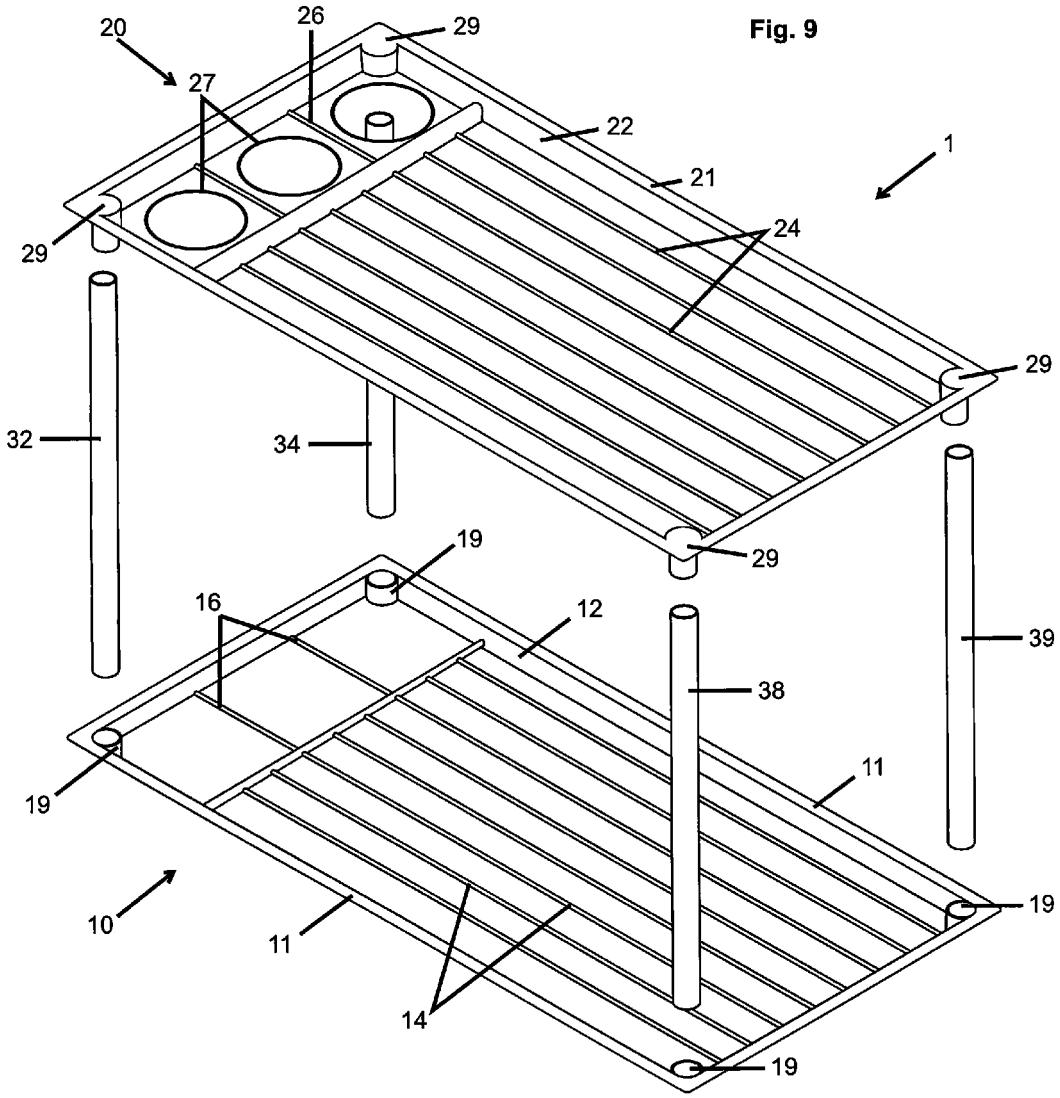
FIG. 9 is an exploded view of the stand of FIG. 1.

FIG. 1 is an upper front right perspective view of the two tiered boot trays 10, 20 with umbrella drip tray stand 1. FIG. 2 is an upper front left perspective view of the stand 1 of FIG. 1. FIG. 3 is a front view of the stand 1 of FIG. 1. FIG. 4 is a rear view of the stand 1 of FIG. 1. FIG. 5 is a top view of the stand 1 of FIG. 1. FIG. 6 is a bottom view of the stand 1 of FIG. 1. FIG. 7 is a left side view of the stand 1 of FIG. 1. FIG. 8 is a right side view of the stand 1 of FIG. 1. FIG. 9 is an exploded view of the stand 1 of FIG. 1.

Referring to FIGS. 1-9, the stand 1 can include a bottom tray 10 and top tray 20 with a plurality of posts 32, 34, 36, 38 interlocking the top tray 20 to the bottom tray 10.

The bottom tray 10 can include raised outer perimeter sidewalls 12, a flat rim edge 11, and a surface with parallel raised ridges 14. Bottom tray 10 can have a rectangular configuration with a first end having raised box outlines 16. Extending upward from corners of the bottom tray 10 can be upwardly protruding sockets 19.

The top tray 20 can include raised outer perimeter sidewalls 22, a flat rim edge 21, and a surface with parallel raised ridges 24. Top tray 20 can have a rectangular configuration with a first end having one or more circular openings 27 therethrough between raised box outlines 26. Extending downward from corners of the top tray 20 can be downwardly protruding sockets 29.

The posts 32, 34, 36, 38 can be vertical hollow supports disposed on the corners of the trays 10, 20. The vertical supports 32, 34, 36, 38 can be elongated rods or tubes each having an upper end and a lower end.

To assemble the stand 1, the upper ends of the posts 32, 34, 36, 38 can be attached by being frictionally positioned over the male stem members 29 under the top tray 20. The bottom ends of the posts 32, 34, 36, 38 can be frictionally inserted into the sockets 19 on the corners of the bottom tray 10. Although the posts and sockets can be frictionally attached to one another, as described, the male stem members and sockets can be reversed on the top of the posts, and/or on the bottom of the posts. Additionally the posts and sockets can also be attached one another by being threadably attached to one another. The stand can be disassembled by reversing the assembly.

Referring to FIGS. 1-7, the stand 1 can be used to store and support outer footwear such as but not limited to shoes, boots, galoshes, and the like. Each of the top tray 20 and bottom tray 10 can include sidewalls 22, 12 extending vertically from the perimeter thereof. The side walls 22, 12 can prevent melted snow, rain, dirt, and mud from getting on the floor from the wet outer footwear. The sidewalls 12, 22 can collect water and prevent puddles from overflowing onto a floor surface.

The bottom tray 10 can accommodate regular size boots, while the top tray 20 can accommodate oversized boots.

The upper surface of the trays 10, 20 can use the treading or ridges 14, 24, thereon to allow the outer footwear to dry easily. The at least one circular opening (round aperture) 27 is adapted to receive an umbrella therethrough.

The trays 10, 20 and posts 32-38 can be formed from molded plastic, metal, wood, and the like.

An assembled version of the stand 1 can have a length of approximately 28 inches with a width of approximately 14.25 inches and a height of approximately 16 inches, with the sidewalls 12, 22 having a heights of approximately 1¼ inches.

The term "approximately" can be +/−10% of the amount referenced. Additionally, preferred amounts and ranges can include the amounts and ranges referenced without the prefix of being approximately.

While the posts and sockets can be frictionally attached to one another, the posts and sockets can also be attached one another by being threadably attached to one another.

Although the top tray and the bottom tray are shown as rectangular, the trays can have other geometry configurations, such as but not limited to square, triangular, hexagon, circular, oval, and the like.

While the top tray shows three openings, the top tray can have less or more openings. In addition, the openings can be initially closed and have circular patterns of perforations, and the like, that the installer and user can remove as desired to determine the number of openings from none to three or more.

Although the multipurpose stand is described as being in an assembled state, the invention can be used with the bottom tray by itself in an unassembled state by placing directly on a floor surface without the top tray for allowing wet and dirty outer footwear to dry. Additionally, the top tray can be used by itself in an unassembled state by placing directly on a floor surface without the top tray for allowing wet and dirty outer footwear.

Although the sockets on the top tray and the bottom tray show cylindrical shaped sockets for use with cylindrical posts, the invention can be used with different shaped sockets, and posts, such as but not limited to square shaped, rectangular shaped, hexagon shaped, arc shaped, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A multipurpose stand for storing and allowing wet outer footwear and umbrellas to dry, comprising:

a bottom rectangular tray with a first side with a raised sidewall and opposite second side with a raised sidewall, a third side with a raised sidewall and an opposite fourth side with a raised sidewall, the first side and second side each being shorter in length than each of the third side and the fourth side , the bottom rectangular tray consisting of a solid contiguous horizontal rectangular surface, and a plurality of parallel straight raised ridges on the contiguous horizontal rectangular surface extending from adjacent to the first side to the second sidewall;

a top tray having a first side with a raised sidewall and opposite second side with a raised sidewall, a third side with a raised sidewall and an opposite fourth side with a raised sidewall, the first side and second side each being shorter in length than each of the third side and the fourth side, the top tray having a horizontal rectangular surface consisting of a single row of circular openings through the top tray adjacent to the first side wall and a contiguous rectangular surface, and a plurality of straight raised ridges between the single row of circular openings and the second side wall; and a plurality of posts for supporting the top tray above the bottom tray, wherein the top tray and the bottom tray are adaptable for holding wet outer footwear thereon, and the circular openings adaptable for wet umbrellas to be supported in substantially vertical orientations.

2. The multipurpose stand of claim 1, further comprising:

downwardly protruding male members on the top tray; and upwardly protruding bottom sockets on the bottom tray, wherein the posts are hollow and slidably attach to the top tray and to the bottom tray.

3. The multipurpose stand of claim 1, wherein the top tray includes an additional single raised sidewall separating the single row of circular openings through the top tray and the plurality of straight parallel raised ridges on the top tray.

4. The multipurpose stand of claim 1, further comprising:

a single row of raised box outlines on the bottom tray directly underneath the single row of openings in the top tray.

5. A method of assembling a multipurpose stand for wet outer footwear and umbrellas, comprising the steps of:

providing a rectangular bottom tray with a first side with a raised sidewall and opposite second side with a raised sidewall, a third side with a raised sidewall and an opposite fourth side with a raised sidewall, the first side and second side each being shorter in length than each of the third side and the fourth side;

providing a plurality of straight parallel raised ridges extending from adjacent to the first side to the second sidewall;

providing the rectangular bottom tray with a solid contiguous surface between the raised sidewalls;

providing a rectangular top tray with a first side with a raised sidewall and opposite second side with a raised sidewall, a third side with a raised sidewall and an opposite fourth side with a raised sidewall, the first side and second side each being shorter in length than each of the third side and the fourth side;

providing a single row of circular openings adjacent one of the sidewalls in the to tray;

providing a plurality of straight parallel raised ridges between the single row of circular openings and the second side wall;

providing a solid contiguous surface between the single row of openings and other sidewalls of the top tray;

providing a plurality of posts, each having upper ends and bottom ends;

attaching the upper ends of the posts to the top tray; and attaching the bottom ends of the posts to the bottom tray.

6. The method of claim 5, further comprising the step of:

placing wet outer footwear on at least one of the top tray and the bottom tray.

7. The method of claim 5, further comprising the step of: positioning at least one umbrella in at least one of the openings of the top tray to orient the umbrella in a vertical orientation.

8. The method of claim 5, further comprising the step of:

providing an additional single raised sidewall separating the single row of openings through the top tray and the plurality of straight parallel raised ridges on the top tray.

9. The method of claim 5, further comprising the step of:

providing a single row of raised box outlines on the bottom tray directly underneath the single row of openings in the top tray.

10. A multipurpose stand for storing and allowing wet outer footwear and umbrellas to dry, comprising:

a bottom rectangular tray with a first side with a raised sidewall and opposite second side with a raised sidewall, a third side with a raised sidewall and an opposite fourth side with a raised sidewall, the first side and second side each being shorter in length than each of the third side and the fourth side , the bottom rectangular tray consisting of a solid contiguous horizontal rectangular surface, and a plurality of parallel straight raised ridges on the contiguous horizontal rectangular surface extending from adjacent to the first side to the second sidewall, a single row of raised box outlines on the bottom tray;

a top tray having a first side with a raised sidewall and opposite second side with a raised sidewall, a third side with a raised sidewall and an opposite fourth side with a raised sidewall, the first side and second side each being shorter in length than each of the third side and the fourth side, the top tray having a horizontal rectangular surface consisting of a single row of circular openings through the top tray adjacent to the first side wall and a contiguous rectangular surface, the single row of circular openings being directly above the single row of raised box outlines on the bottom tray, a plurality of straight raised ridges between the single row of circular openings and the second side wall, an additional single raised sidewall separating the single row of circular openings through the top tray and the plurality of straight parallel raised ridges on the top tray; and a plurality of posts for supporting the top tray above the bottom tray, wherein the top tray and the bottom tray are adaptable for holding wet outer footwear thereon, and the circular openings adaptable for wet umbrellas to be supported in substantially vertical orientations.

* * * * *